US008707547B2

(12) United States Patent
Lee

(10) Patent No.: US 8,707,547 B2
(45) Date of Patent: Apr. 29, 2014

(54) METHOD FOR FABRICATING A LEAD-FRAMELESS POWER INDUCTOR

(75) Inventor: Wei Chih Lee, New Taipei (TW)

(73) Assignee: Inpaq Technology Co., Ltd., Miaoli (TW)

( * ) Notice: Subject to any disclaimer, the term of this patent is extended or adjusted under 35 U.S.C. 154(b) by 0 days.

(21) Appl. No.: 13/547,434

(22) Filed: Jul. 12, 2012

(65) Prior Publication Data

US 2014/0015630 A1 Jan. 16, 2014

(51) Int. Cl.
*H01F 3/00* (2006.01)
*H01F 41/02* (2006.01)

(52) U.S. Cl.
USPC ..... 29/604; 29/602.1; 29/605; 29/606; 336/110; 336/178; 336/184; 336/214; 336/215; 363/17; 363/48; 363/58

(58) Field of Classification Search
CPC ..... H01F 5/04; H01F 5/06; H01F 41/00; H01F 41/06; H01F 41/0641; H01F 41/005; H01F 41/0246; H01F 41/10; H01F 41/125; H01F 27/004; H01F 27/027; H01F 27/06; H01F 27/2828; H01F 27/324
USPC ..... 29/592.1, 602.1, 605–607; 336/110, 336/178, 184, 214, 215, 234; 363/17, 48, 363/58
See application file for complete search history.

(56) References Cited

U.S. PATENT DOCUMENTS 7,367,000 B2 * 4/2008 Kurihara et al. ..... 716/115
8,058,960 B2 * 11/2011 Hebert et al. ..... 336/200

* cited by examiner

*Primary Examiner* — Paul D Kim
(74) *Attorney, Agent, or Firm* — Bacon & Thomas, PLLC

(57) ABSTRACT

A lead-frameless power inductor and its fabrication method are disclosed. The power inductor comprises a lower substrate, a coil provided on the lower substrate, and an intermediate layer which encloses the coil, wherein the lower substrate can be a soft magnetic entrainer or a non-magnetic entrainer. The coil is made of an insulated wire, and the intermediate layer is a colloid consisting of magnetic powder. A method for fabricating the lead-frameless power inductor includes steps of preparing a lower substrate; forming a plurality of conducting metal layers on the lower substrate; forming a wire package on an upper surface of said lower substrate; coating a surface of said wire package with a magnetic powder; dividing the substrate into a plurality of granulated elements by cutting process; and forming the conducting metal layer on both sides of the element to form a surface mounting device.

7 Claims, 19 Drawing Sheets

METHOD FOR FABRICATING A LEAD-FRAMELESS POWER INDUCTOR

BACKGROUND OF THE INVENTION

1. Field of the Invention

The present invention relates to a lead-frameless power inductor and method for fabricating the same, and more particularly to a lead-frameless power inductor which is fabricated in a whole set instead of being fabricated in the individual unit as that is conducted in the conventional way of production so as to promote the production efficiency and curtail the production cost, and at the same time, improve reliability of the electrical is connection between the power inductor produced as such with the external conductor terminals.

2. Description of Prior Art

Referring to FIG. 1A through 1D, which are the drawings of U.S. Pat. No. 6,204,744B1. In the drawings, a coil 10 which is attached to a circuit board 12, has an enclosure 14. From the enclosure 14 there extend a first conductor 16 and a second conductor 18 each respectively welded to welding pads 20 and 22. The coil 10 is a helical winding body 24 with multiple turns 30 of an erected rectangular cross sectional flat wire. The coil 10 includes an inner side end 26 and an outer side end 28, and a lead frame 32 is attached to the winding body 24 with its two terminals 34 and 38 each respectively welded to the inner side end 26 and the outer side end 28 of the winding body 24. Afterwards the winding body 24 with both welded conductors 16, 18 is set in a mold, and then the mold filled with preferably, a colloidal magnetic powder. After the magnetic powder is dried and hardened, the lead frame 32 is severed and taken away. The finished product of the inductor of the invention is obtained.

However, the inductor fabricated according to U.S. Pat. No. 6,204,744B1 has the following flaws, namely:

1. Using the flat wire as a winding element with two is external free end terminals is technically quite difficult to perform winding work.
2. As shown in FIG. 1D, if a round wire is used to wind up the coil 10, the coil 10 containing multiple layers of round wire element will increase the fabrication cost, and by no means meet the basic requirements of light, thin, short, compact which the present day electric products are asking for.
3. In the procedure of the fabrication, the conductors are at first welded to the coil body, and then the entire structure is put into the mold, and finally the magnetic powder is filled into the mold. In this way the perfect adhesiveness of the enclosing magnetic powder with the coil body and compactness of the whole inductor structure cannot be expected.
4. As the winding number of turns increases, the loosing of the inductance is severe owing to the electro-magnetic interference among the layers of coil element.
5. One by one fabrication process as that conducted at present leads to a great loss of manpower and time with a result of low production efficiency. In the fabrication, the two ends of the coil are at first welded to the corresponding two supporting legs of the lead frame, and the connecting conductors are cut after completing the fabrication to separate the lead frame. This also is causes the loss of material and increase of the fabrication cost.
6. In a traditional power inductor, the way of connection of the inductor to the outer conductor terminals belongs to a point-to-point contact. In this manner, when the power inductor is used under the circumference in which the temperature is violently changed or loaded for a long time, the coil body and the outer electrical terminals may be easily disconnected causing an accidental open circuit, or moreover, a burn down of the load side electronic product.

For these defects noticeable on the prior art, an improvement is seriously required. The inventor has dedicated great efforts for years to studying and improving these defects and finally come out with the present invention.

SUMMARY OF THE INVENTION

Accordingly, it is an object of the present invention to provide a lead-frameless power inductor and method for fabricating the same in which mass production of the power inductor can be performed at one time efficiently so as to curtail the production cost, and the finished product can fulfill the aims of light, thin, short and compact to meet the requirements of the present-day electronic devices.

To achieve the above object, the present invention provides a power inductor in which a conductor layer is formed on a lower substrate, next, forming conductor packages among the conductors, and then enclosing the conductor packages with a colloidal magnetic powder, and then cutting the substrate in granulate structure and forming in order.

In the present invention, the coil leads of a inductor unit do not have to be welded to the supporting legs of the lead frame to form the terminals of the inductor unit. In this way, the process of preparing the lead frame and welding the coil leads can be omitted so that the cost of fabrication can be greatly reduced.

In the present invention, omission of preparing a lead frame results in saving the cost of the lead frame, and the cost of performing process of cutting off the lead frame.

The power inductor fabricated as such not only has the advantageous features qualified for the modern electronic device as described above, but also has a significant feature that its coil is closely combined with the outer electric terminals within the main body of the inductor without the fear of accidental separation of coil from its lead wires resulting in breakdown of the whole electronic installation.

BRIEF DESCRIPTION OF THE DRAWINGS

The following drawings, which are included to provide further understanding of the invention and incorporated in and constitute part of this specification, illustrate embodiments of the invention and together with the description serve to explain the principles of the invention; wherein.

DETAILED DESCRIPTION OF THE PREFERRED EMBODIMENTS

Figure 1A:
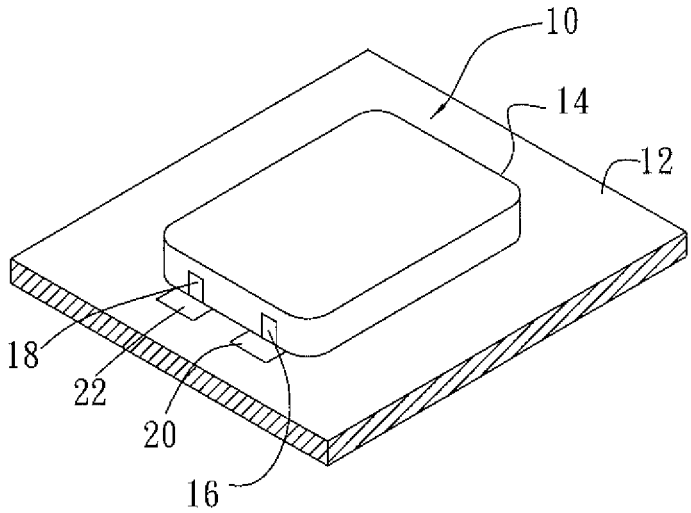
FIG. 1A (Prior Art)
FIG. 1A~FIG. 1D show an embodiment of U.S. Pat. No. 6,204,744B1.
Figure 1B:
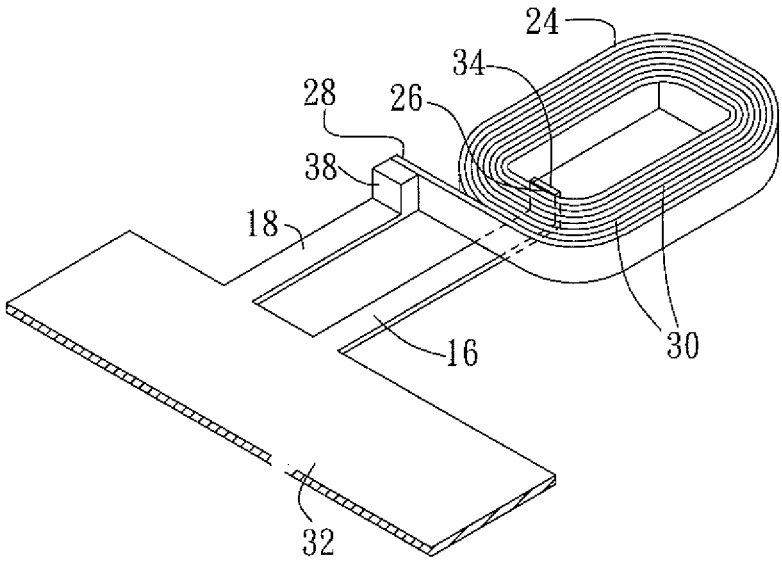
FIG. 1B (Prior Art)
Figure 1C:
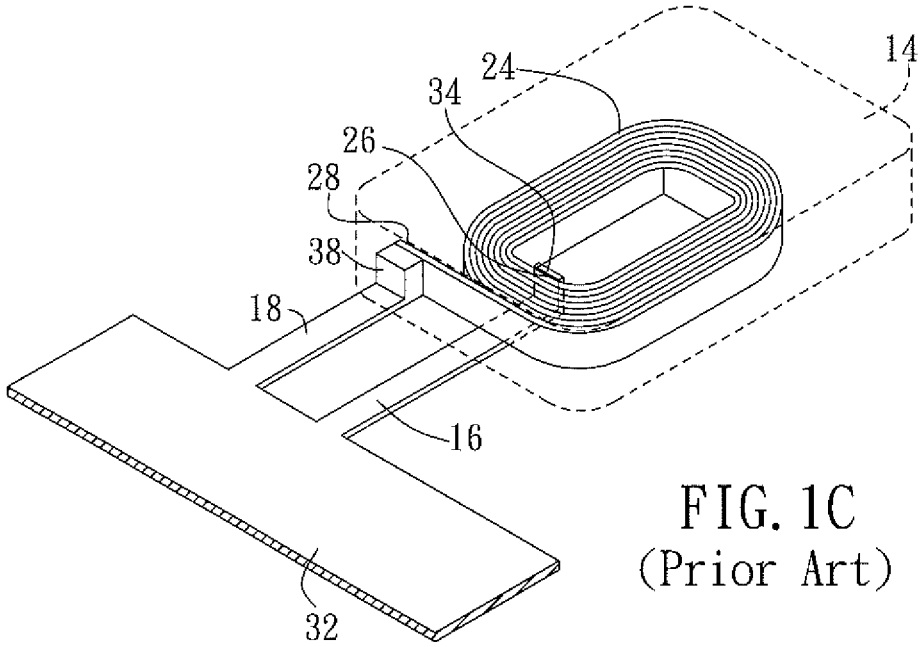
FIG. 1C (Prior Art)
Figure 1D:
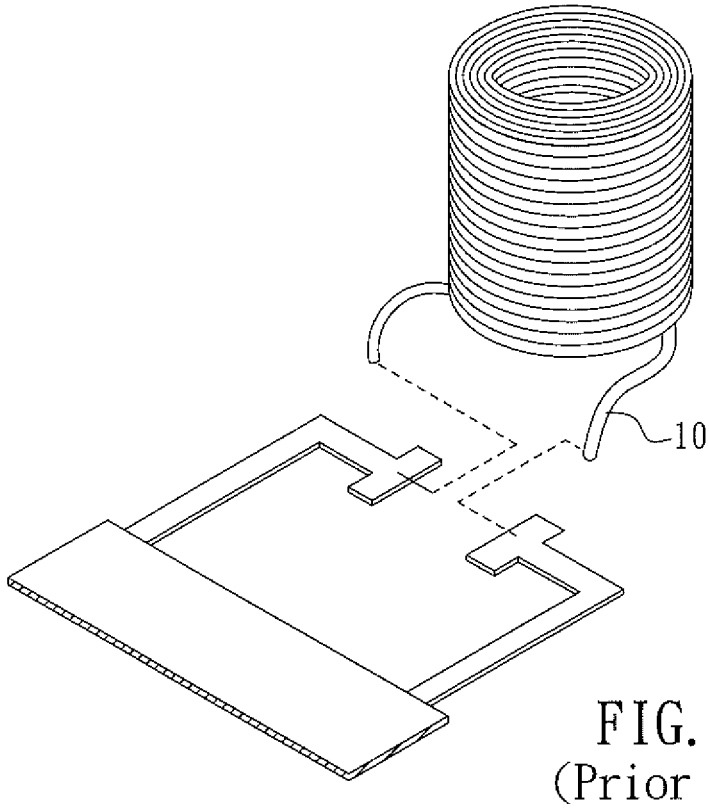
FIG. 1D (Prior Art)
Figure 2:
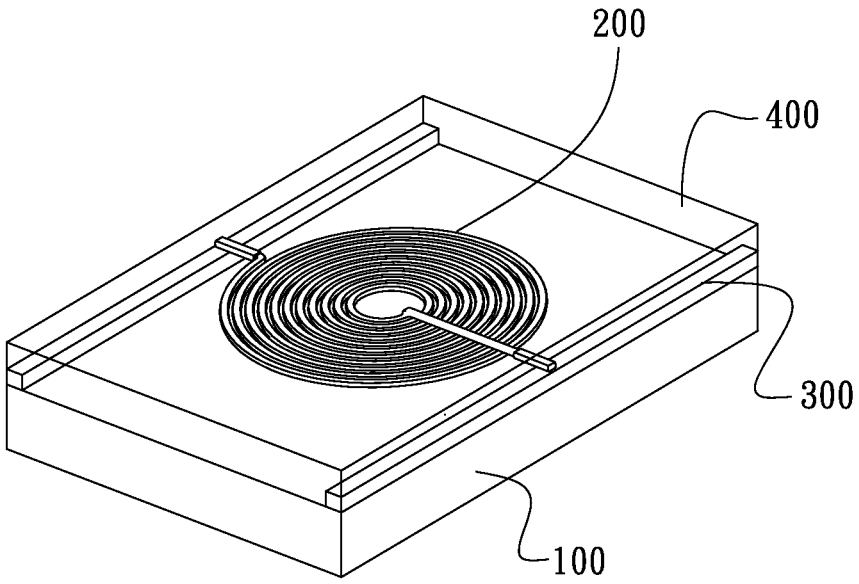
FIG. 2 is a perspective view of the power inductor according to the present invention.

The power inductor described as in FIG. 2 comprises a lower substrate 100, a conducting layer 300 formed on the lower substrate 100, a coil 200 loaded on the lower substrate 100, and an enclosing layer 400 enclosing the coil 200, wherein the lower substrate 100 may be a soft magnetic or a non-magnetic entrainer. The coil 200 is formed of conducting wire wrapped with an insulating layer. The conducting layer 300 is formed of Ag, Sn, Cu, Al, Ni, or other conducting materials. The conducting layer 300 and the coil 200 is electrically in connection with each other. The enclosing layer 400 is made of colloidal substance containing the magnetic powder, and covers coil 200, conducting layer 300, and lead wires connecting the coil 200 to the conducting layer 300.

The method of fabrication of the power inductor comprises the following steps.

[Embodiment 1]

Figure 3:
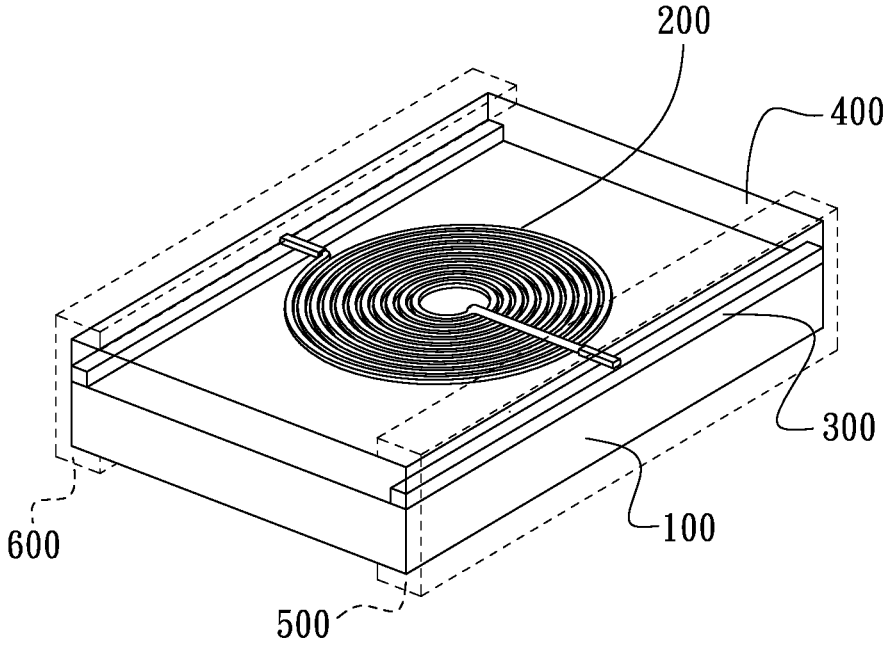
FIG. 3 is a perspective view of the power inductor according to the present invention in which electrical terminals are formed at both sides of the main body.
Figures 1, 4:
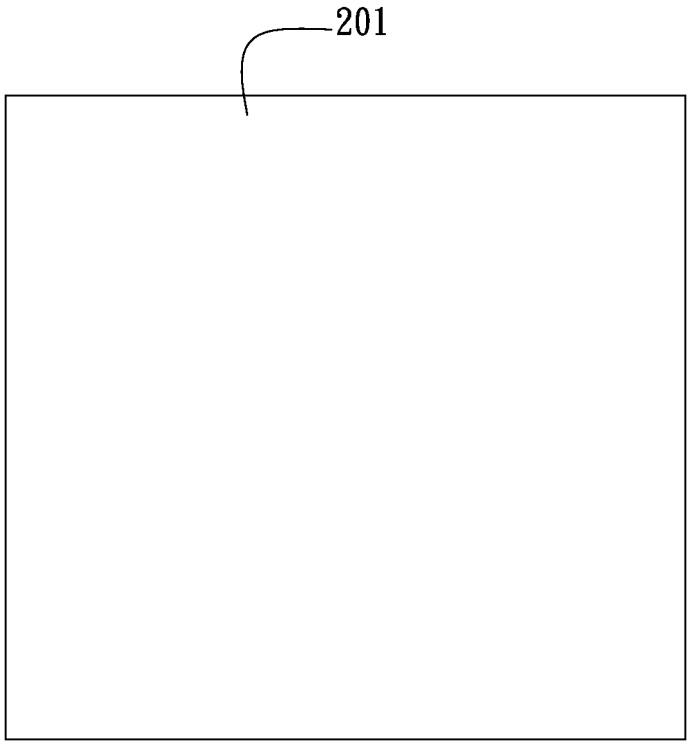
FIG. 4-1~FIG. 4-10 are illustrative plan views showing flow of fabrication method of the power inductor according to a first embodiment of the present invention.
Figures 2, 4:
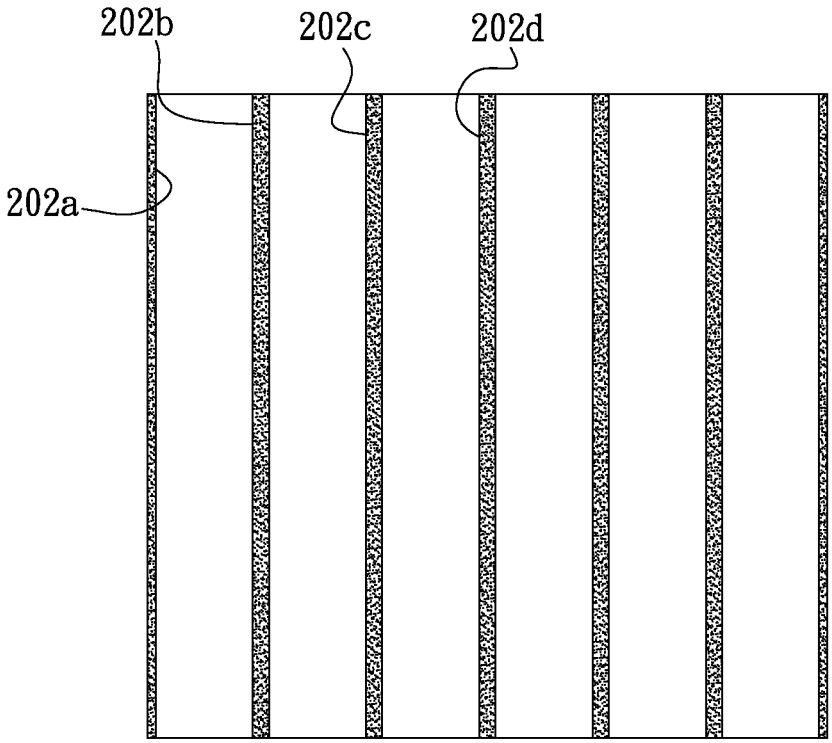
Figures 3, 4:
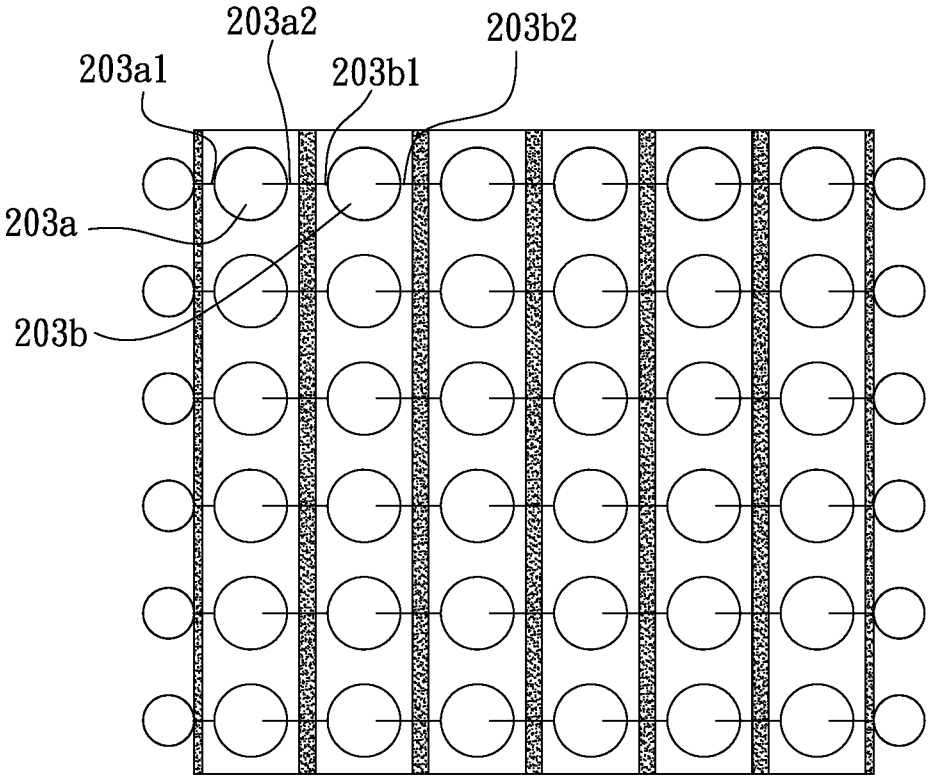
Figure 4:
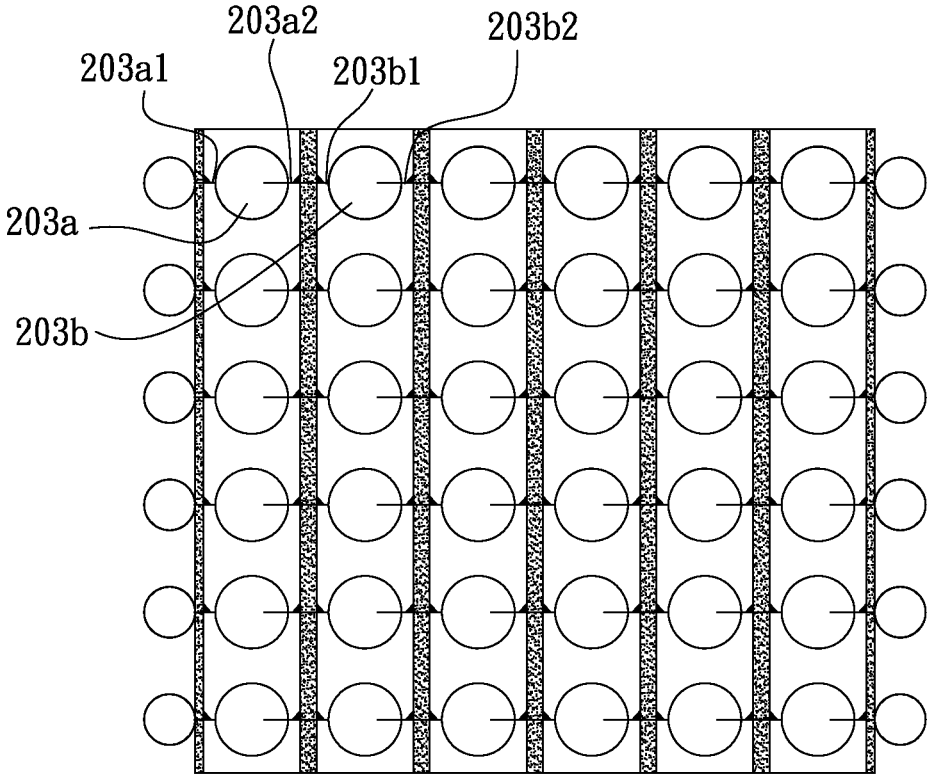
Figures 4, 5:
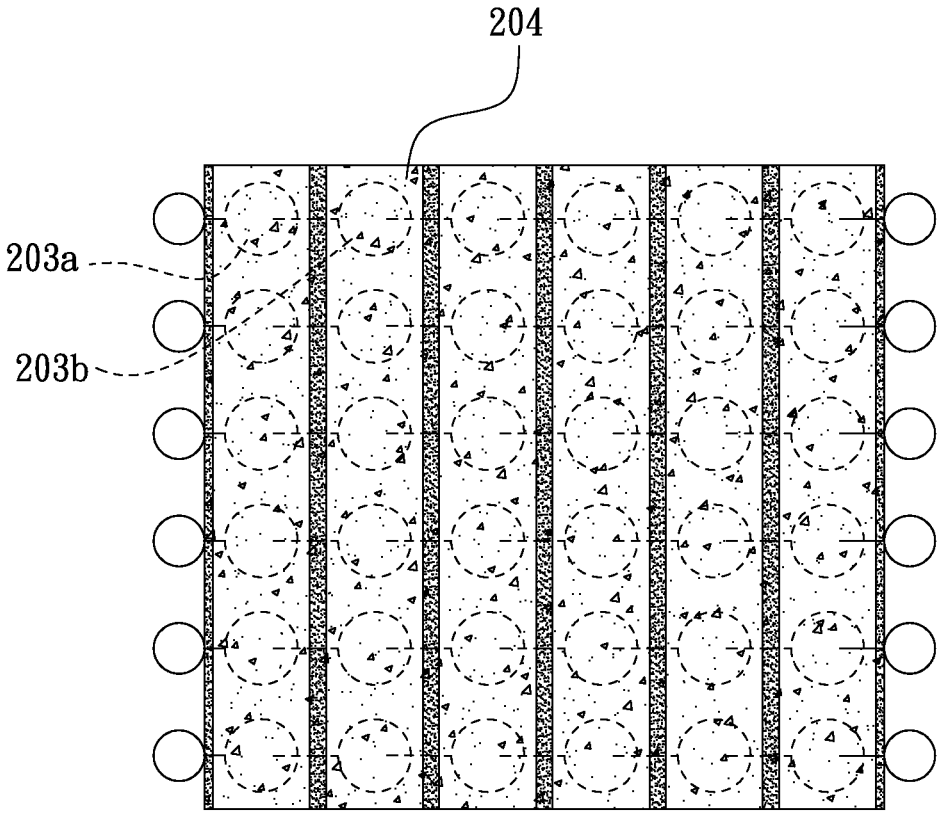
Figures 4, 5, 6:
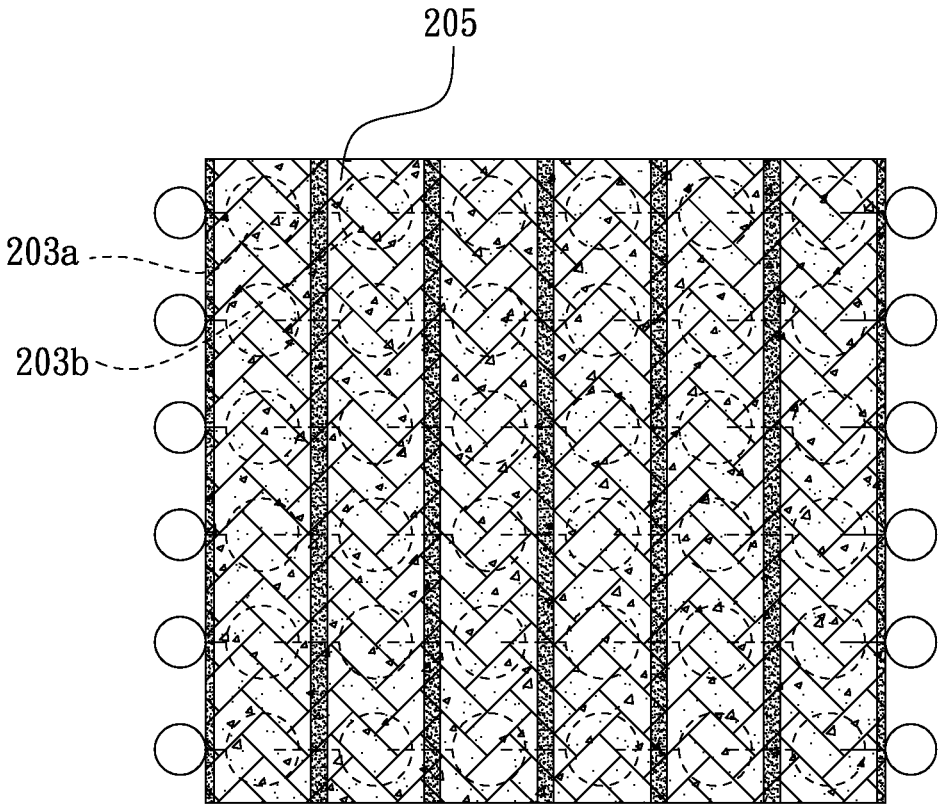
Figures 4, 5, 6, 7:
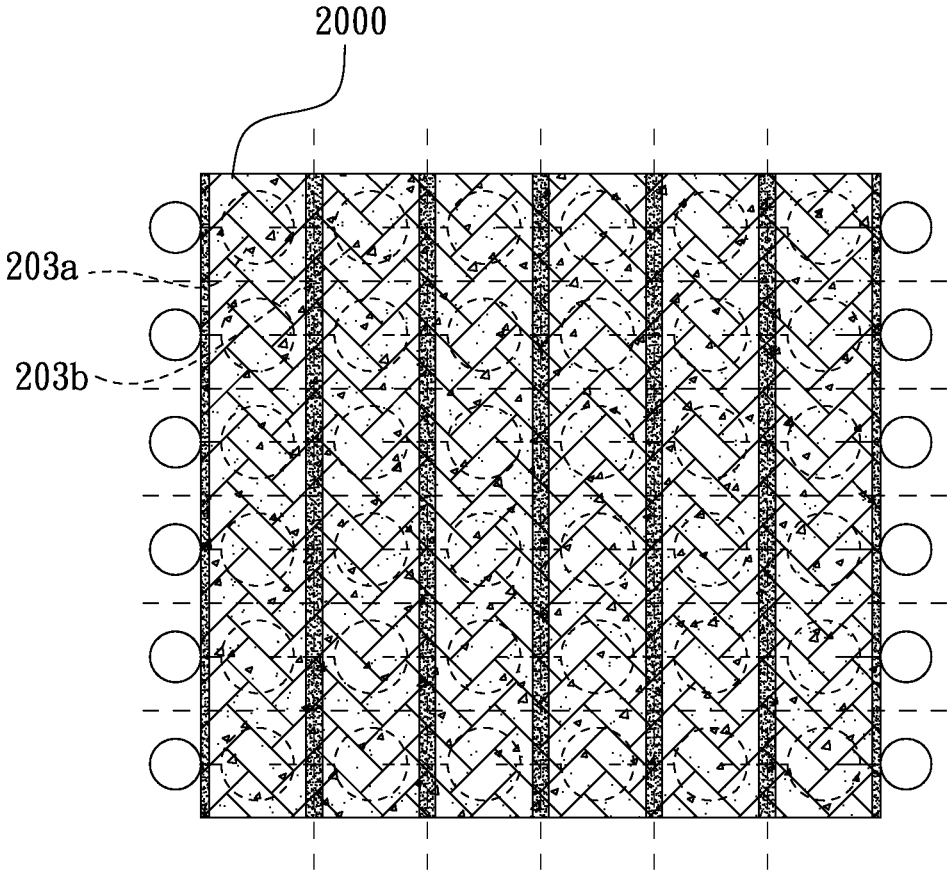
Figures 4, 5, 6, 7, 8:
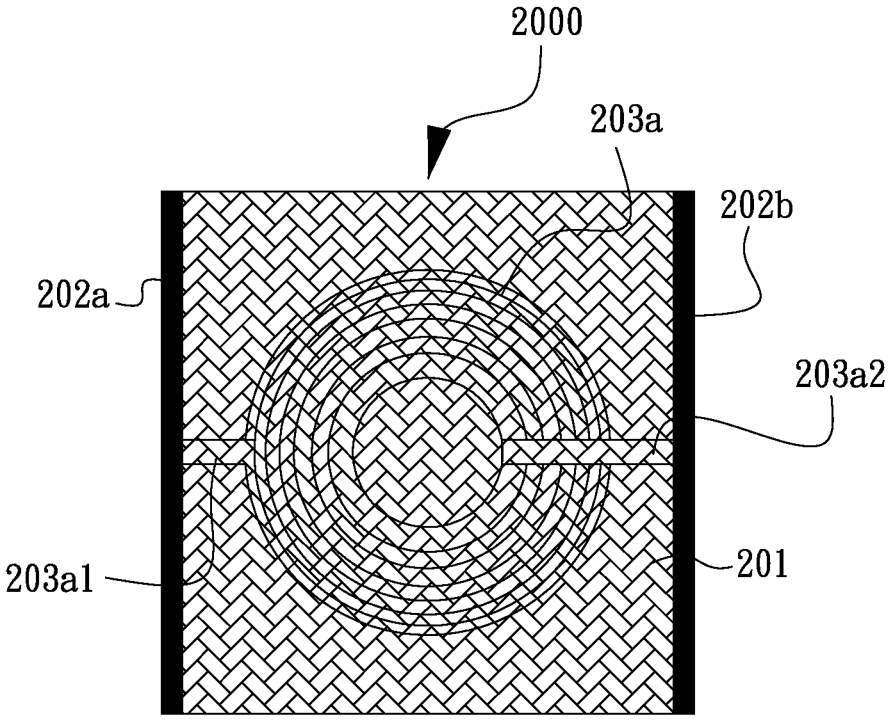
Figures 4, 5, 6, 7, 8, 9:
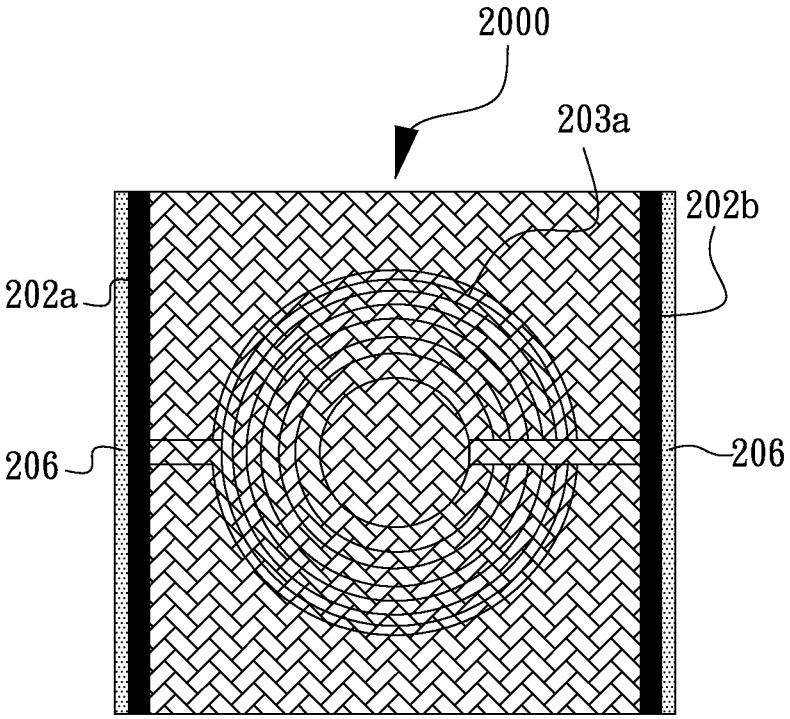
Figures 4, 5, 6, 7, 8, 9, 10:
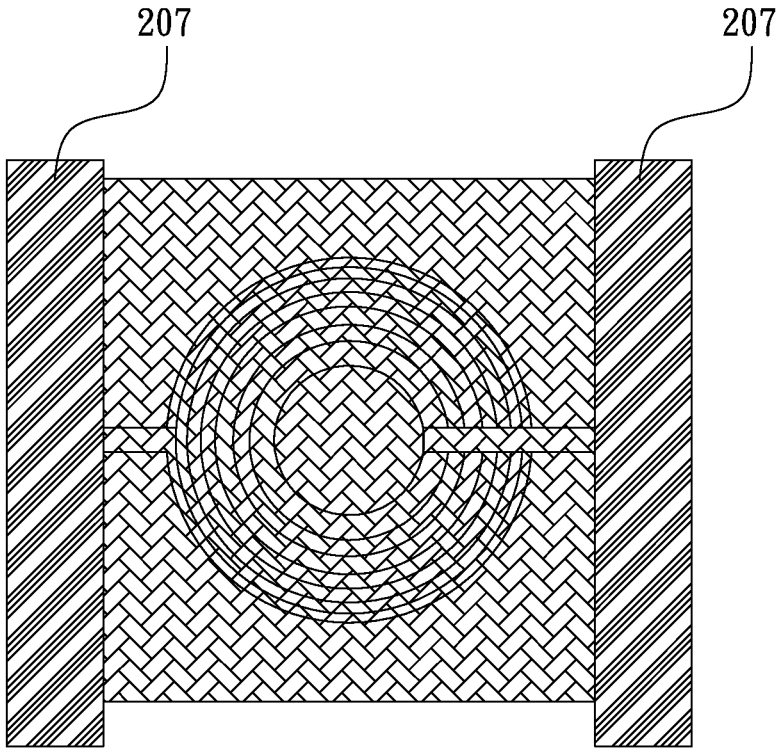

1. Preparing a lower substrate 201 which is a soft magnetic entrainer or a non-magnetic entrainer made of for example, iron oxide, or aluminum oxide, or PET (see FIG. 4-1).
2. Forming a plurality of separated conducting metal layers 202*a*, 202*b*, 202*c*, . . . made of Cu, Ag, Al, Sn, Ni, or other conducting materials, or their alloys stacked one another on the lower substrate 201.
3. Forming a wire package 203 on the upper surface of the lower substrate 201. The wire package 203 is an assembly of a plurality of coil units arrayed to form a matrix. Between two adjacent coil units 203*a*, 203*b* . . . , arrayed to form a matrix. Between two adjacent coil units 203*a*, 203*b* . . . there are their lead wires 203*a*1, 203*a*2, 203*b*1, 203*b*2. The two adjacent coil units share the same lead wires 203*a*2, 203*b*1 etc. The wire package 203 is formed of a copper wire or the like, and covered with an insulated layer such as the lacquer finished wire (see FIG. 4-3)
4. Making electrical connection between the lead wires 203*a*1, 203*a*2, 203*b*1, 203*b*2 . . . of the coil units 203*a*, 203*b* . . . and the corresponding conducting metal layers 202*a*, 202*b* . . . so as to set the coil units 203*a*, 203*b* . . . between two separated conducting metal layers 202*a*, 202*b* . . . (see FIG. 4-4). This process is performed by welding or heat pressing.
5. Coating the surface of the wire package 203 with a magnetic powder consisting colloid, this magnetic powder may be a ferrite or iron and its alloy powder (see FIG. 4-5). In this way, the stress can be greatly reduced due to the colloidal magnetic powder structure is coated instead of being molded so that the structure is uneasy to crack and suitable for making into a thin product.
6. Covering an upper substrate 205 on the upper surface of the colloid 204 serving as a fixing layer (see FIG. 4-6). The upper and the lower substrates 205, 201 may be formed of the same material. After that baking the workpiece at 200° C., so as to harden the colloid 204 and stick it to the upper substrate 205 (it is allowable to omit the upper substrate 205).
7. Dividing and separating the baked and hardened substrate into granulated elements 2000 by cutting process (see FIG. 4-7 and FIG. 4-8).
8. By processes of printing, chemical welding or sputtering weld, forming a conducting layer 206 on the lead wire exposing layer opposite to the granulated element. The conducting layer 206 may be made of Ag, Cu, In, Al or Ni (see 4-9) in a thickness of 0.1~100 μm.
9. Forming another conducting metal layer 207 (see 4-10) by chemical welding process. The conducting metal layer 207 consists of metals Ag/Ni/Sn, Cu/Ni/Sn, or Cu/Sn in order so as to form the product a surface mounting device.

[Embodiment 2]

Figure 5A:
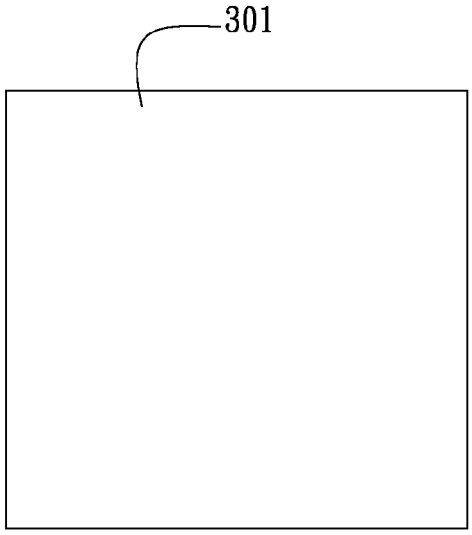
FIG. 5A~FIG. 5J are illustrative plan views showing flow of fabrication method of the power inductor according to a second embodiment of the present is invention.
Figure 5B:
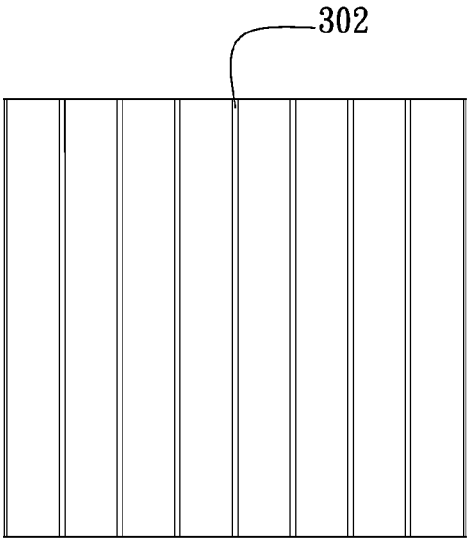
Figure 5C:
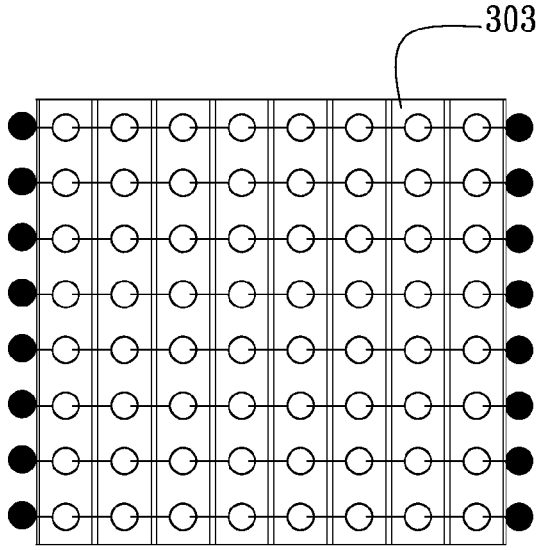
Figure 5D:
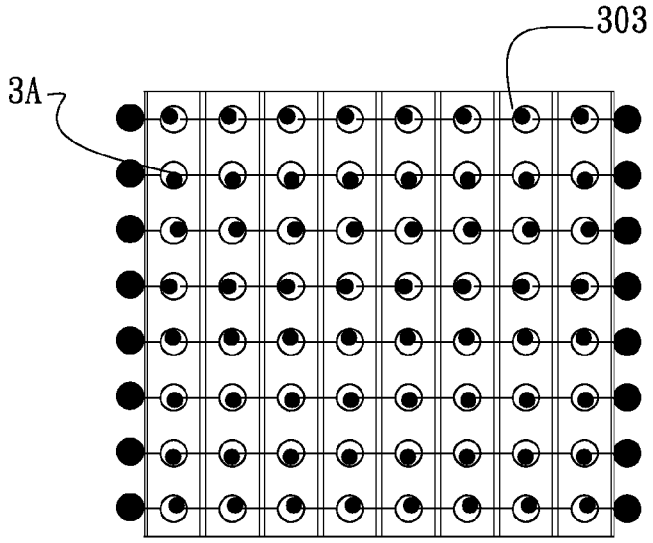
Figure 5E:
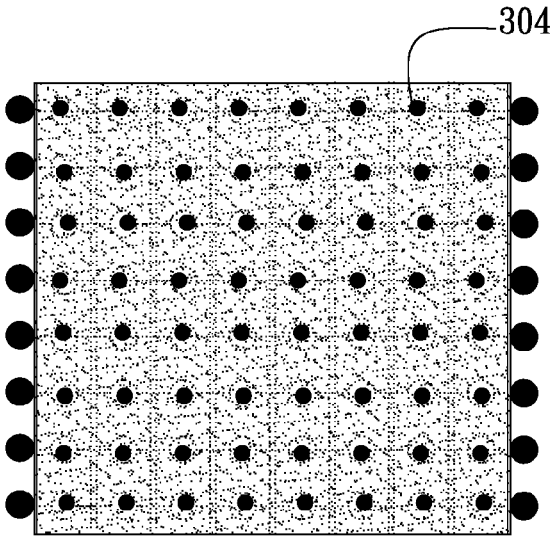
Figure 5F:
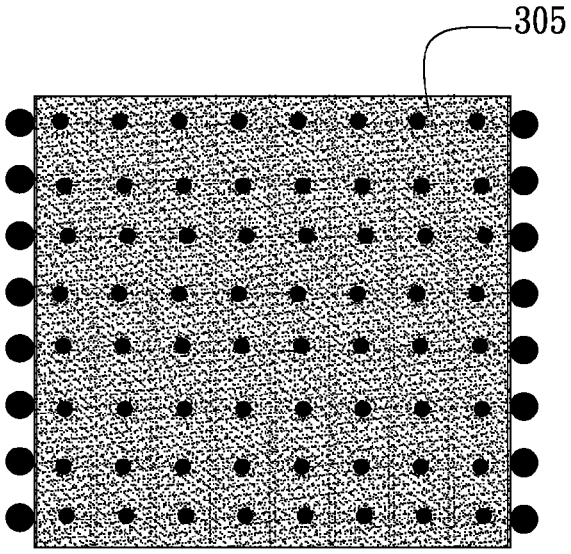
Figure 5G:
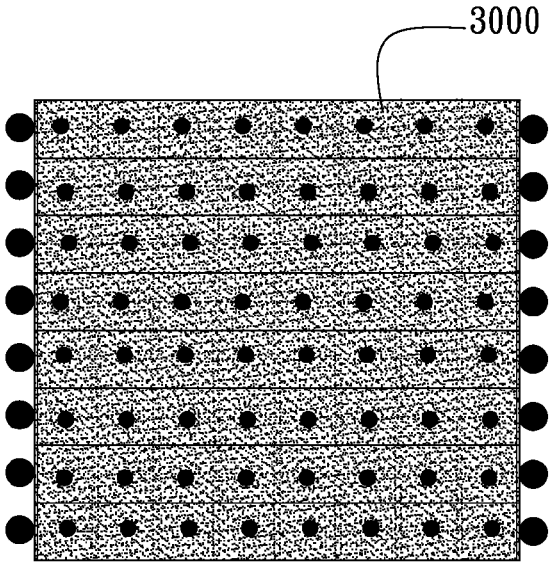
Figure 5H:
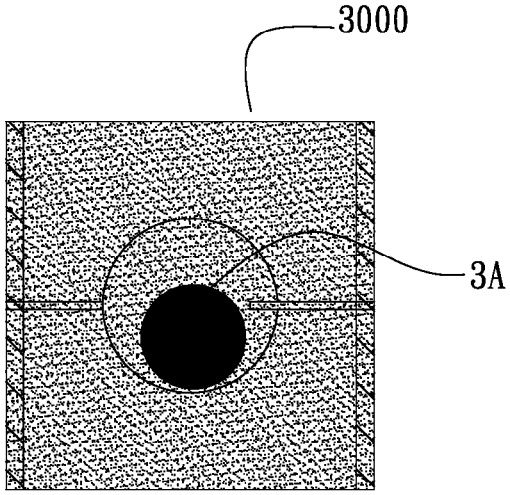
Figure 5I:
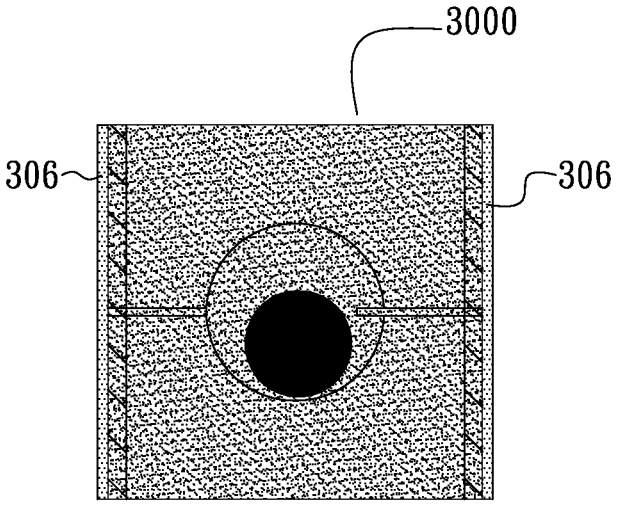
Figure 5J:
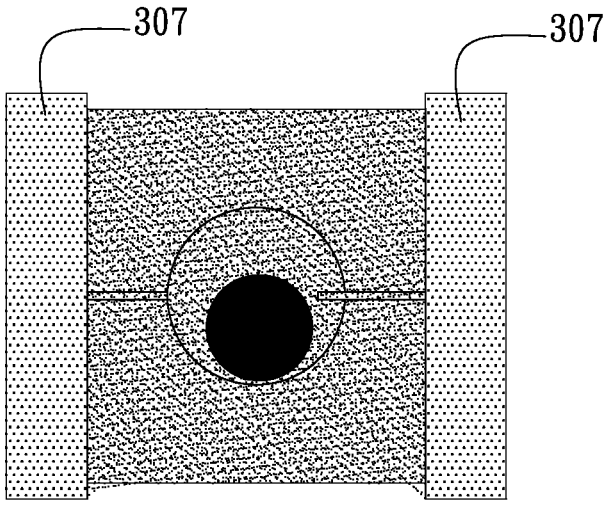

1. Preparing a lower substrate 301 which is a soft magnetic entrainer or a non-magnetic entrainer made of for example, iron oxide, or aluminum oxide, or PET (see FIG. 5A).
2. Forming a plurality of separated conducting metal layers 302 made of Cu, Ag, Al, Sn, Ni, or other conducting materials, or their alloys stacked one another on the lower substrate 301 (see FIG. 5B).
3. Forming a wire package 303 on the upper surface of the lower substrate 301. The wire package 303 is an assembly of a plurality of coil units arrayed to form a matrix. Between two adjacent coils there are their lead wires. The two adjacent coil units share the same lead wires. The wire package 303 is formed of a copper wire or the like, and covered with an insulation layer such as the lacquer finished insulation wire. The coil package 303 is fixed to the substrate at its two sides with a jig (see FIG. 5C). By welding or heat pressing, making electrical connection between the lead wires of the coil unit of the wire package 303 and the corresponding conducing metal layers 302 so as to set the coil unit between two separated conducting metal layers 302.
4. Inserting a post 3A into each coil of the wire package 303. The post 3A is configurated in a rod structure made of a magnetic material or non-magnetic material, for example, Fe or its alloy or oxide. The post 3A is for adjusting the electric properties of the power inductor (see FIG. 5D)
5. Coating the surface of the wire package 303 with a magnetic powder consisting colloid 304, this magnetic powder may be a ferrite or iron and its alloy powder (see FIG. 5E). In this way, the stress can be greatly reduced due to the colloidal magnetic powder structure is formed by coating instead of being mold so that the structure is uneasy to crack and suitable for making into a thin product.
6. Covering an upper substrate 305 on the upper surface of the colloid 304 serving as a fixing layer (see FIG. 5F). The upper and the lower substrate 305, 301 may be formed of the same material. After that baking the workpiece at 200° C. so as to harden the colloid 304 and stick it to the upper substrate 305 (it is allowable to omit the upper substrate 305).
7. Dividing the baked and hardened substrate into granulated elements 3000 by cutting process (see FIG. 5H).
8. By processes of printing, chemical welding or sputtering weld, forming a conducting layer 306 on the is lead wire exposing layer opposite to the granulated element 3000. The conducting layer 306 may be made of Ag, Cu, In, Al or Ni (see FIG. 5I) in a thickness of 0.1~100 μm.
9. Forming another conducting metal layer 307 (see FIG. 5J) by chemical welding process. The conducting metal layer 307 consists of metals Ag/Ni/Sn, Cu/Ni/Sn, or Cu/Sn in order so as to form the structure a surface mounting device.

In the step 2 of the embodiment 2, the conducting metal layer 302 can be formed of conducting substances Cu, Ag, Al, Sn, Ni or the like with melting point 200~600° C., or their stacked alloys. By so, it can be expected to burn down under the over temperature state that offers the power inductor of the present invention the protective effect like a fuse unit.

In step 6 of the embodiment 2, 200° C. baking temperature is only one exemplary value used in the embodiment 2, and should not be construed as an only one limited value of temperature to be carried out in the fabrication process.

It is understood that lead-frameless power inductor and its fabrication method of the present invention is a high level technical creation and, by no means, simply utilizes conventional technology or knowledge known prior to the is application for patent or can easily made by persons skilled in the arts. The power inductor according to the present invention has the merits of simple in construction, easy to fabricate, secure to operate. The present invention will surely improve the quality of the traditional power inductor and benefit the present electronic engineering. The invention has neither been published nor put to pubic, therefore it is entitled for patent.

It is apparent to a person skilled in the art that the basic idea of the invention can be implemented in many different ways. The invention and its embodiments are thus not restricted to the examples described above, but may vary with the scope of the claims.

What is claimed is:

1. A method for fabricating a lead-frameless power inductor comprising the steps of:

preparing a lower substrate;

forming a plurality of separated conducting metal layers on said lower substrate;

forming a wire package on an upper surface of said lower substrate, wherein said wire package is an assembly of coil units arrayed to form a matrix, and said coil units have insulation layers on their surfaces so as to set each coil unit between two adjacent conducting layers, and lead wires between two adjacent coil units are connected with said conducting metal layers and fixed;

with an enclosing layer made of a magnetic powder consisting colloid;

dividing and separating said substrate into a plurality of granulated elements by cutting process, wherein each divided granulated element has conducting metal layers at two sides of its upper surface, said coil unit is formed between two adjacent conducting metal layers, said coil unit is connected with said conducting metal layer with said lead wires, and said conducting metal layers, said coil units, and said lead wires are covered with said enclosing layer; and forming said conducting metal layer on both sides of said element so as to form a product of a surface mounting device.

2. The method for fabricating a lead-frameless power inductor as claimed in claim 1, further comprising, forming an upper substrate to cover an upper surface of said enclosing layer serving as a fixing layer.

3. The method for fabricating a lead-frameless power inductor as claimed in claim 2, wherein said lower substrate and said upper substrate are entrainers made of a soft magnetic material or a non-magnetic material.

4. The method for fabricating a lead-frameless power inductor as claimed in claim 1, wherein a thickness of said conducting metal layers is 0.1~100 μm.

5. The method for fabricating a lead-frameless power inductor as claimed in claim 1, wherein said wire package is formed of a copper wire and covered with an insulation layer of lacquer, by welding or heat pressing, making an electrical connection between said lead wires of the coil unit of said wire package and the corresponding conducting metal layers.

6. The method for fabricating a lead-frameless power inductor as claimed in claim 1, wherein the magnetic powder of said enclosing layer comprises at least one material selected from a group consisting of a ferrite material, a ferrite material alloy powder, iron and an iron alloy powder.

7. The method for fabricating a lead-frameless power inductor as claimed in claim 1, wherein said conducting metal layers are formed of Ag/Ni/Sn, Cu/Ni/Sn or Cu/Sn.

* * * * *